US011316287B2

(12) United States Patent
Tohyama et al.

(10) Patent No.: US 11,316,287 B2
(45) Date of Patent: Apr. 26, 2022

(54) CONNECTION DEVICE AND ELECTRIC WIRE CONNECTION STRUCTURE

(71) Applicant: YAZAKI CORPORATION, Tokyo (JP)

(72) Inventors: Eiichi Tohyama, Makinohara (JP); Kazuyuki Oiwa, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/094,834

(22) Filed: Nov. 11, 2020

(65) Prior Publication Data

US 2021/0151903 A1 May 20, 2021

(30) Foreign Application Priority Data

Nov. 15, 2019 (JP) ..... JP2019-207267

(51) Int. Cl.

| | |
|---|---|
| ***H01R 4/20*** | (2006.01) |
| ***H01R 4/18*** | (2006.01) |
| ***H01R 9/05*** | (2006.01) |
| ***H01R 43/048*** | (2006.01) |

(52) U.S. Cl.

CPC ..... *H01R 4/183* (2013.01); *H01R 4/20* (2013.01); *H01R 9/0518* (2013.01); *H01R 43/048* (2013.01)

(58) Field of Classification Search

CPC . H01R 4/10; H01R 4/18; H01R 4/183; H01R 4/186; H01R 4/20; H01R 9/0518; H01R 9/07; H01R 43/048

USPC ..... 174/75 C, 84 R, 88 R, 88 C, 91–93; 439/578–585, 638, 650–655, 675, 877

See application file for complete search history.

(56) References Cited

U.S. PATENT DOCUMENTS

| | | | | |
|---|---|---|---|---|
| 3,331,917 A * | 7/1967 | O'Keefe | ..... | H01R 9/0518 174/75 C |
| 3,441,659 A * | 4/1969 | Laudig | ..... | H02G 15/113 174/88 C |
| 3,859,455 A * | 1/1975 | Gommans | ..... | H01R 9/0503 174/88 C |

(Continued)

FOREIGN PATENT DOCUMENTS

| | | |
|---|---|---|
| EP | 2833488 A1 | 2/2015 |
| JP | 2011-171057 A | 9/2011 |

(Continued)

*Primary Examiner* — William H. Mayo, III

(74) *Attorney, Agent, or Firm* — Kenealy Vaidya LLP

(57) ABSTRACT

A connection device includes a first braided conductor having a tubular shape, and a second braided conductor having a tubular shape. The connection device also includes a tubular member having a first opening end and a second opening end, and the tubular member having conductivity. A first annular member fixed to the first opening end in a state that the first braided conductor is sandwiched coaxially between the first annular member and an outer peripheral surface of the first opening end. A second annular member fixed to the second opening end in a state that the second braided conductor is sandwiched coaxially between the second annular member and an outer peripheral surface of the second opening end. The first braided conductor and the second braided conductor are conductively connected to each other through the tubular member.

11 Claims, 5 Drawing Sheets

(56) References Cited

U.S. PATENT DOCUMENTS

| | | | | |
|---|---|---|---|---|
| 3,872,237 | A * | 3/1975 | Eyre | H01P 1/045 174/88 C |
| 5,217,392 | A * | 6/1993 | Hosler, Sr. | H01R 9/0503 174/88 C |
| 2018/0233893 | A1 | 8/2018 | Adachi et al. | |

FOREIGN PATENT DOCUMENTS

| | | | |
|---|---|---|---|
| JP | 2018-133837 | A | 8/2018 |
| JP | 2019-40829 | A | 3/2019 |
| WO | 2011/102536 | A1 | 8/2011 |

* cited by examiner

CONNECTION DEVICE AND ELECTRIC WIRE CONNECTION STRUCTURE

CROSS REFERENCE TO RELATED APPLICATIONS

This application is based on Japanese Patent Application (No. 2019-207267) filed on Nov. 15, 2019, the contents of which are incorporated herein by reference.

BACKGROUND OF THE INVENTION

1. Field of the Invention

The present disclosure relates to a connection device configured to conductively connect a pair of tubular braided conductors to each other, and an electric wire connection structure configured to connect a pair of electric wires using the connection device.

2. Description of the Related Art

In the related art, an electric wire including a tubular braided conductor surrounding a conductive core wire has been proposed (for example, see JP-A-2011-171057). This type of electric wire prevents electrical noise from being generated in peripheral electronic devices or the like by collecting (shielding) electromagnetic waves emitted from the conductive core wire or the like to a periphery by a braided conductor.

The electric wire including the braided conductor as described above is usually covered with a single braided conductor extending from one end to the other end of the electric wire, and an end of the braided conductor is connected to a member to be grounded (for example, a shield case that covers a connector attached to the electric wire), so that a current generated in the braided conductor due to the collected electromagnetic waves is emitted to the member to be ground, That is, a connection destination of the braided conductor is usually the member to be grounded. Even when the electric wire is branched and connected, since a device for branching and connecting the electric wire is usually interposed, the braided conductor is connected to a ground point or the like on the device. Thus, within a scope of electric wire applications in the related art, it is unlikely that one braided conductor needs to be connected to another braided conductor.

However, it is also assumed that one braided conductor and another braided conductor are required to be electrically connected to each other so as to support various new electric wire applications (for example, a case of directly connecting electric wires including conductive core wires formed of different materials). From this background, it is desired to provide a method for connecting the braided conductors without impairing original functions (such as a noise shielding property) of the braided conductors.

An object of the present disclosure is to provide a connection device capable of appropriately electrically connecting a pair of braided conductors, and a connection structure configured to connect a pair of electric wires using the connection device.

SUMMARY OF THE INVENTION

In order to achieve the above-described object, a connection device and an electric wire connection structure according to the present disclosure is characterized as follows There is provided a connection device that includes a first braided conductor having a tubular shape, a second braided conductor having a tubular shape, a tubular member having a first opening end and a second opening end, the tubular member having conductivity, a first annular member configured to be fixed to the first opening end in a state that the first braided conductor is sandwiched coaxially between the first annular member and an outer peripheral surface of the first opening end, and a second annular member configured to be fixed to the second opening end in a state that the second braided conductor is sandwiched coaxially between the second annular member and an outer peripheral surface of the second opening end. The first braided conductor and the second braided conductor are conductively connected to each other through the tubular member.

According to the present disclosure, it is possible to provide a connection device capable of appropriately electrically connecting the braided conductors, and a connection structure configured to connect a pair of electric wires using the connection device.

The present disclosure has been briefly described as above. Details of the present disclosure described below will be further clarified by reading a mode (hereinafter, referred to as an "embodiment") for carrying out the present disclosure with reference to the accompanying drawings.

DETAILED DESCRIPTION OF THE EXEMPLARY EMBODIMENTS

Embodiment

Figure 1:
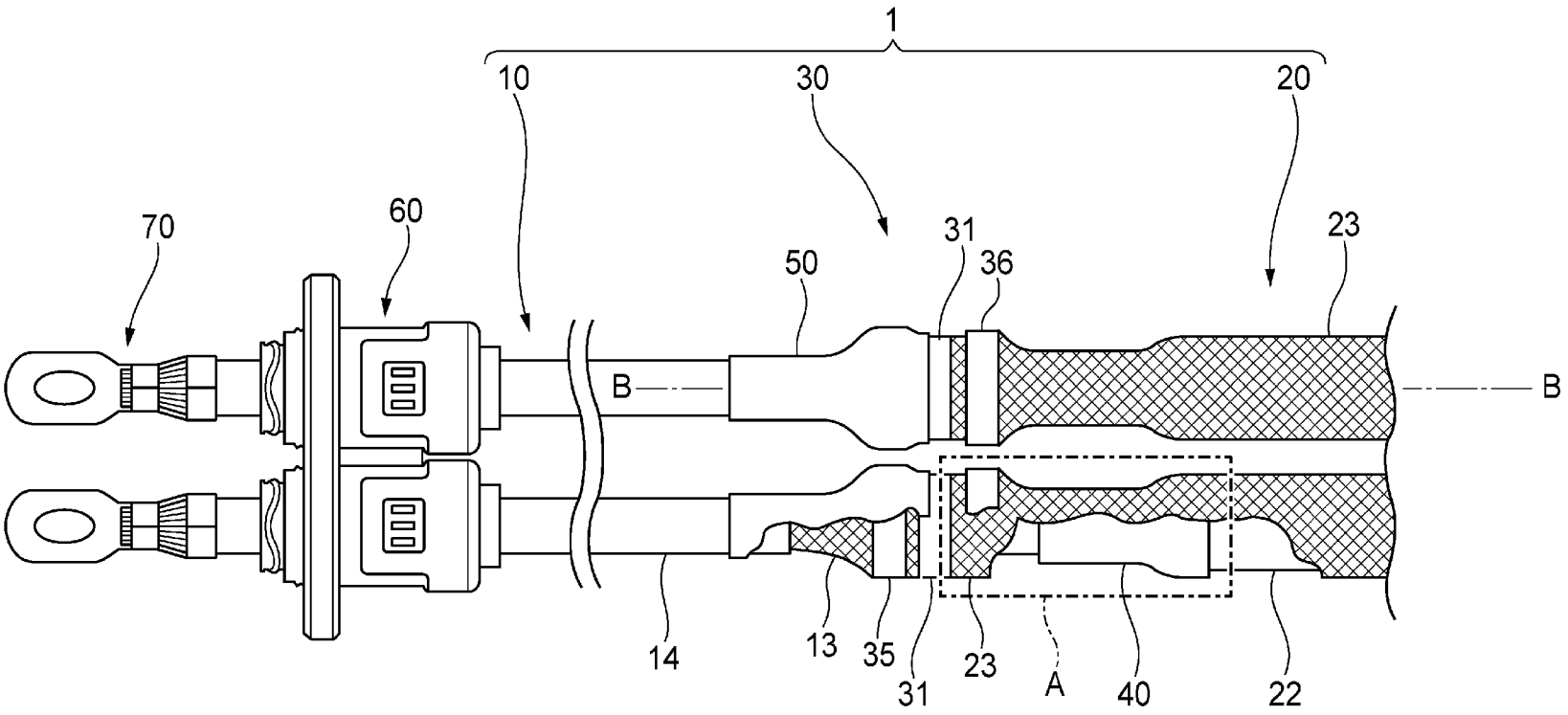
FIG. 1 is a plan view showing an electric wire connection structure according to an embodiment of the present disclosure.
Figure 5:
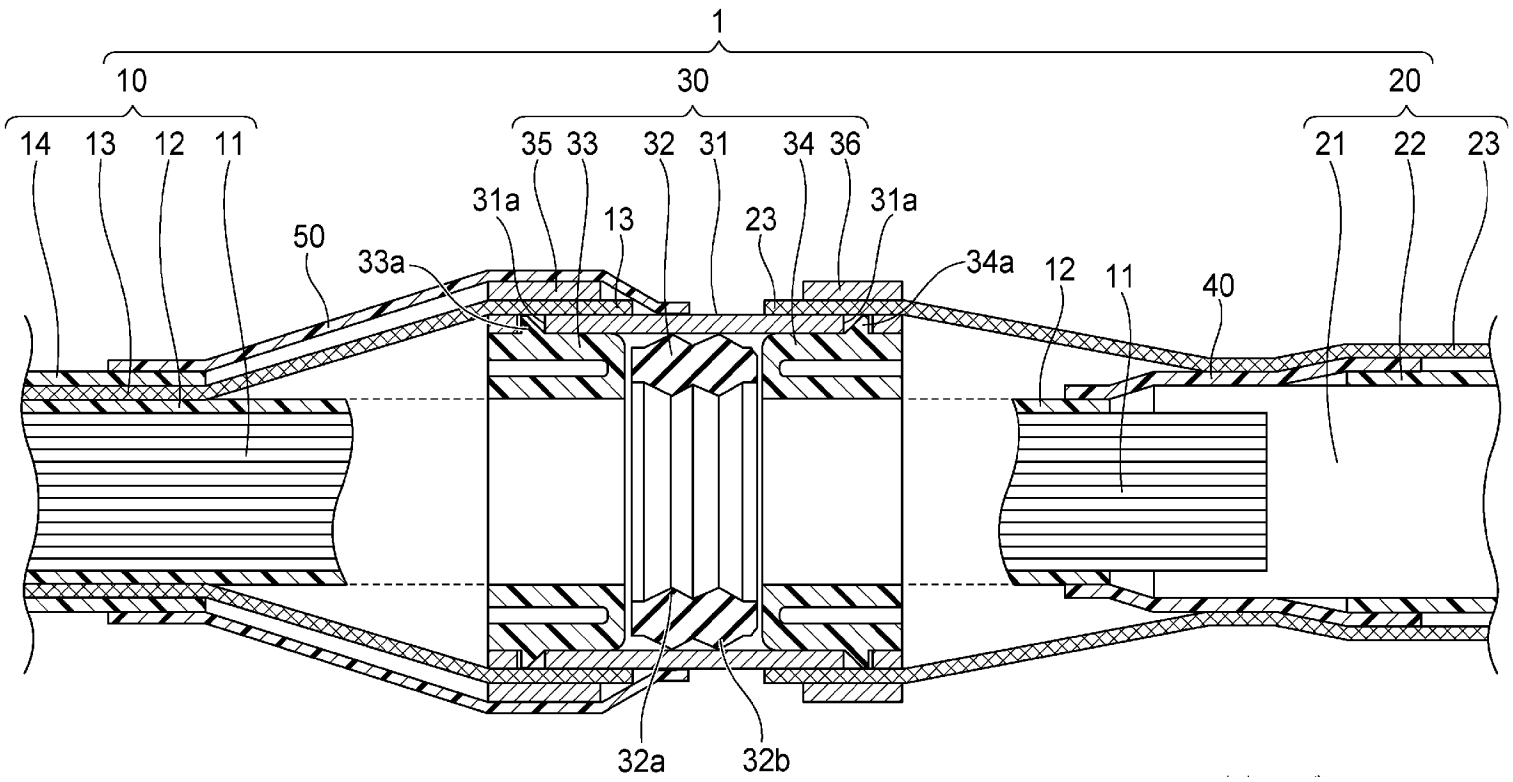
FIG. 5 is a cross-sectional view that includes an axis shown by a line B-B in FIG. 1 and is viewed from a front side of a paper surface of FIG. 1.

Hereinafter, an electric wire connection structure 1 according to an embodiment of the present disclosure will be described with reference to the drawings. The electric wire connection structure 1 includes a connection device 30 according to an embodiment of the present disclosure. As shown in FIGS. 1 and 5, the electric wire connection structure 1 is a structure configured to conductively connect a first braided conductor 13 of a first electric wire 10 and a second braided conductor 23 of a second electric wire 20 to each other using the connection device 30, and to electrically connect a first conductive core wire 11 of the first electric wire 10 and a second conductive core wire 21 of the second electric wire 20 to each other.

Figure 2:
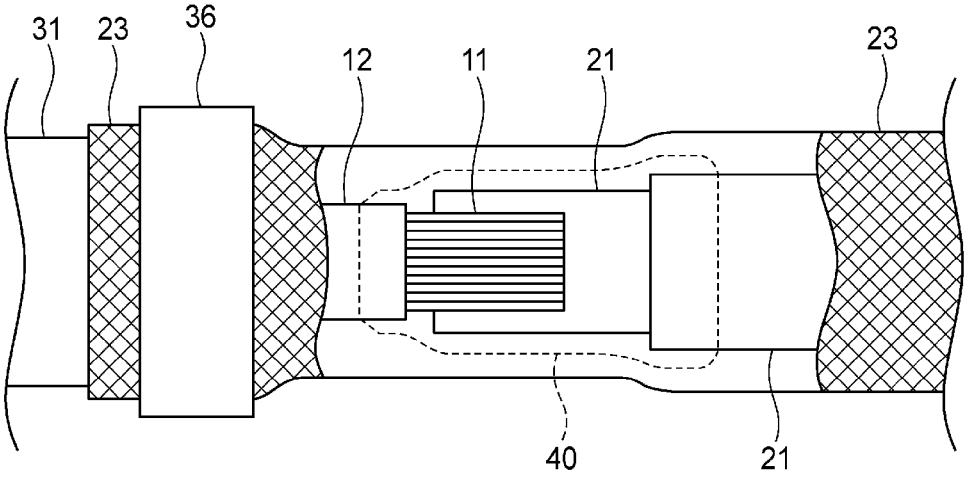
FIG. 2 is an enlarged view of a part A in FIG. 1.

Hereinafter, for convenience of description, left and right sides in FIG. 1 of the connection device 30 extending in a left-right direction in FIG. 1 will be referred to as "one side" and "the other side", respectively. In FIG. 1, for each of the first electric wire 10 and the second electric wire 20 that extend in the left-right direction, a side toward the connecting tool 30 is referred to as a "front end side", and a side away from the connection device 30 is referred to as a "base end side". For convenience of description, in FIG. 1, a part of members is cut out by a break line, and the cut-out part is not shown. As a result, in FIG. 1, an internal structure of the connection structure 1 is shown in the cut-out part. The actual connection structure 1 naturally does not have this cut-out part. The same applies to FIGS. 2 and 5.

In an example shown in FIG. 1, each of front end side end portions of the pair of first electric wires 10 is connected to a respective one of front end side end portions of the pair of second electric wires 20 by the connection structure 1. Connectors 60 are provided in a vicinity of base end side end portions of the pair of first electric wires 10, and terminals 70 are connected to the base end side end portions of the pair of first electric wires 10. The connectors 60 are typically used by being assembled to a high-voltage battery or the like mounted on a vehicle. Each terminal 70 is conductively connected to the braided conductor 13 of the first electric wire 10, and is typically connected to a ground point of the vehicle. Hereinafter, a configuration of each component of the electric wire connection structure 1 will be described in order.

Figure 3A:
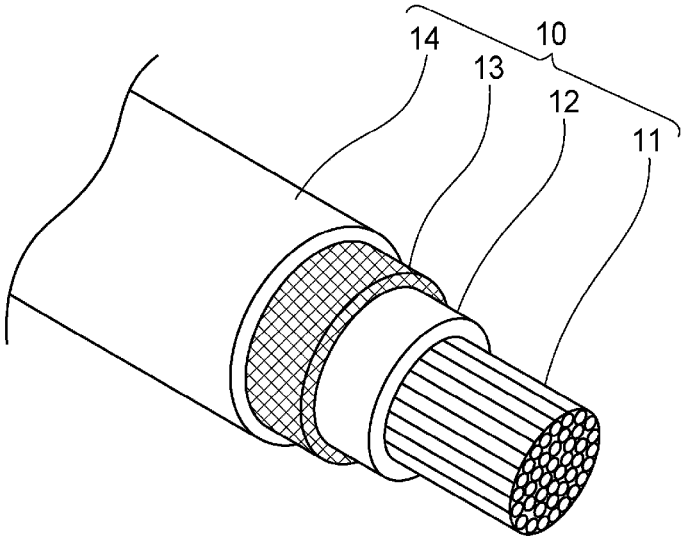
FIG. 3A is a perspective view showing a front end portion of a first electric wire shown in FIG. 1.
Figure 3B:
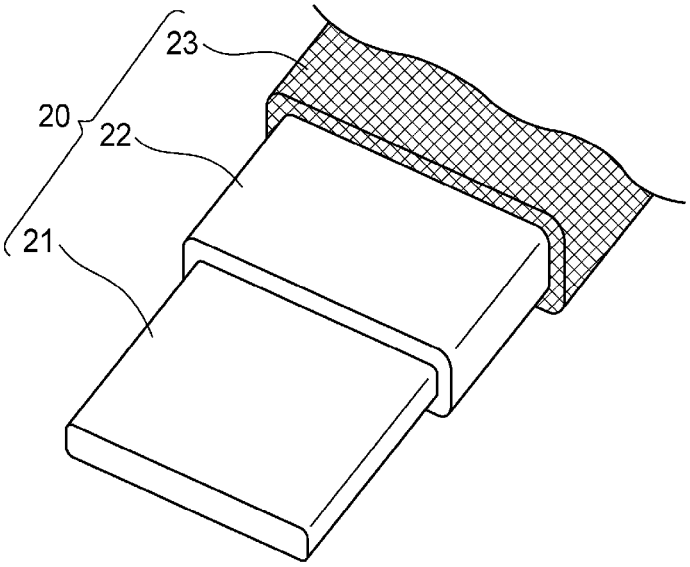
FIG. 3B is a perspective view showing a front end portion of a second electric wire shown in FIG. 1.

First, the first electric wire 10 will be described. As shown in FIGS. 1, 3A and 5, the first electric wire 10 includes the round rod-shaped first conductive core wire 11 in which a plurality of thin wires are bundled, a cylindrical resin inner sheath 12 that covers the first conductive core wire 11, the cylindrical first braided conductor 13 that surrounds the inner sheath 12, and a cylindrical resin outer sheath 14 that covers the first braided conductor 13. In this example, the first conductive core wire 11 is formed of copper or a copper alloy.

Next, the second electric wire 20 will be described. As shown in FIGS. 1, 2, 3B, and 5, the second electric wire 20 includes the flat plate-shaped second conductive core wire 21 and a rectangular tubular resin sheath 22 that covers the second conductive core wire 21. Further, the rectangular tubular second braided conductor 23 surrounds the sheath 22 of the second electric wire 20. In this example, the second conductive core wire 21 is formed of aluminum or an aluminum alloy. The second braided conductor 23 may be provided in advance on the second electric wire 20 as a member of the second electric wire 20, or may be a member separate from the second electric wire 20 and may surround the second electric wire 20 when the connection structure 1 is formed.

Next, the connection device 30 will be described. As shown in FIGS. 1, 4A, 4B, and 5, the connection device 30 includes a cylindrical tubular member 31, an annular water stop ring 32, a cylindrical first electric wire holder 33, a cylindrical second electric wire holder 34, a cylindrical first annular member 35, and a cylindrical second annular member 36.

Figure 4A:
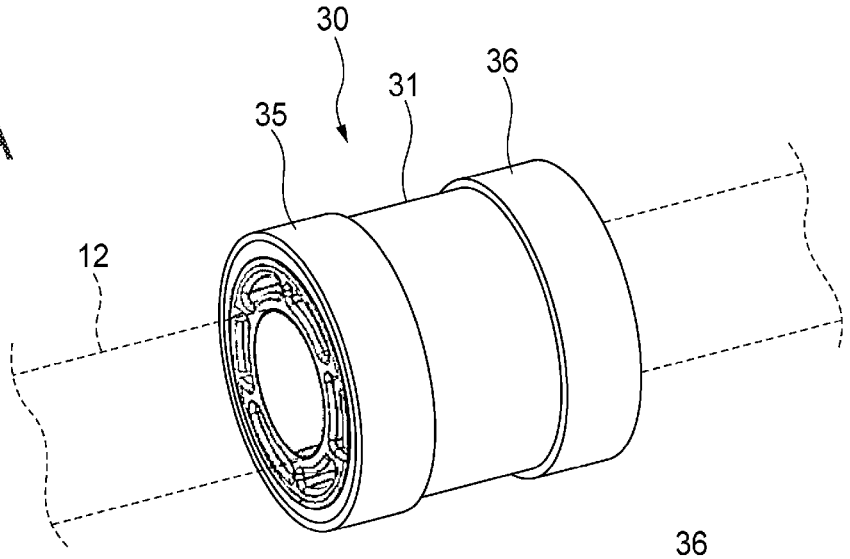
FIG. 4A is a perspective view showing a connection device according to an embodiment of the present disclosure.
Figure 4B:
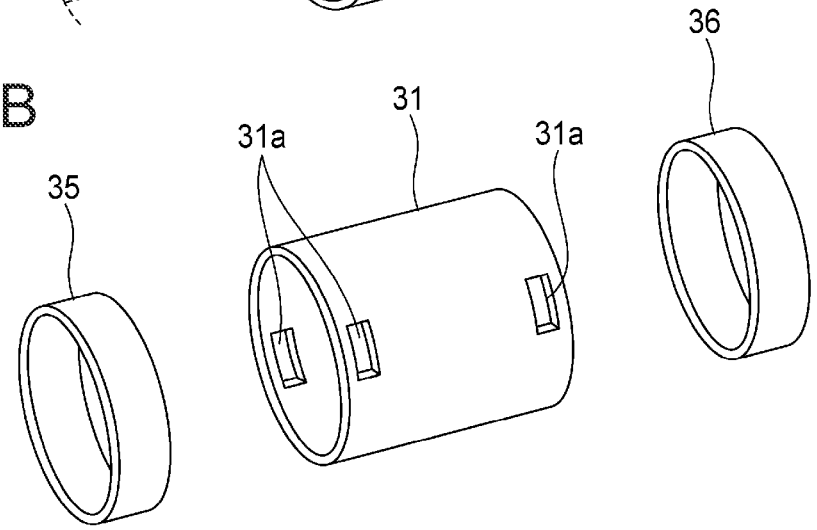
FIG. 4B is a perspective view showing a tubular member, a first annular member, and a second annular member that constitute the connection device.

In this example, the tubular member 31 is a metal cylindrical member as shown in FIG. 4B. As shown in FIG. 5, the first electric wire 10 (the first conductive core wire 11 covered with the inner sheath 12) is inserted into the tubular member 31 from one side. Locking holes 31*a* penetrating in a radial direction are formed at a plurality of positions (two positions in this example) in the circumferential direction at both end portions of the tubular member 31 in a tubular axial direction.

The water stop ring 32 is formed of rubber, and is provided at a center of a hollow part of the tubular member 31 in the tubular axial direction (See FIG. 5). An inner peripheral lip portion 32*a* and an outer peripheral lip portion 32*b* are formed on an outer peripheral surface and an inner peripheral surface of the water stop ring 32, respectively (see FIG. 5). The outer peripheral lip portion 32*b* is in close contact with the inner peripheral surface of the tubular member 31, and the inner peripheral lip portion 32*a* is in close contact with the outer peripheral surface of the inner sheath 12 of the first electric wire 10 inserted into the tubular member 31. Accordingly, the water stop ring 32 functions to seal an annular gap formed between the tubular member 31 and the inner sheath 12 of the first electric wire 10 inserted into the tubular member 31.

Figure 4C:
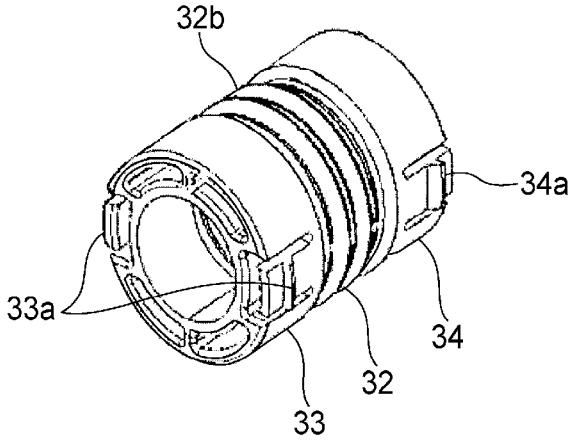
FIG. 4C is a perspective view showing a water stop ring, a first electric wire holder, and a second electric wire holder that constitute the connector.

The first electric wire holder 33 is formed of resin, and is provided at a position adjacent to one side of the water stop ring 32 in the hollow part of the tubular member 31 (see FIG. 5). As shown in FIG. 4C, on the outer peripheral surface of the first electric wire holder 33, lock protrusions 33*a* protruding outward in the radial direction are formed at a plurality of positions (two positions in this example) in the circumferential direction corresponding to the plurality of locking holes 31*a* on the one side of the tubular member 31. When the first electric wire holder 33 is inserted into the hollow portion of the tubular member 31, the lock protrusion 33*a* engages with the locking hole 31*a* on the one side of the tubular member 31, so that the first electric wire holder 33 is fixed to the tubular member 31.

The second electric wire holder 34 is formed of resin, and in this example, is the same member as the first electric wire holder 33. The second electric wire holder 34 is provided in a direction opposite to the first electric wire holder 33 in the tubular axial direction (see FIG. 5). The second electric wire holder 34 is provided at a position adjacent to the other side of the water stop ring 32 in the hollow part of the tubular member 31 (see FIG. 5). As shown in FIG. 4C, on an outer peripheral surface of the second electric wire holder 34, lock protrusions 34*a* protruding outward in the radial direction are formed at a plurality of positions (two positions in this example) in the circumferential direction corresponding to the plurality of locking holes 31*a* on the other side of the tubular member 31. When the second electric wire holder 34 is inserted into the hollow portion of the tubular member 31, the lock protrusion 34*a* engages with the locking hole 31*a* on the other side of the tubular member 31, so that the second electric wire holder 34 is fixed to the tubular member 31.

As described above, the first and second electric wire holders 33, 34 are fixed to the tubular member 31, so that the first and second electric wire holders 33, 34 function to appropriately fix the tubular member 31 (that is, the connection device 30) to the inner sheath 12 of the first electric wire 10 inserted into the tubular member 31.

The first annular member 35 is formed of metal, and is fixed to an outer peripheral surface of one side end portion of the tubular member 31 in a state in which the first braided conductor 13 of the first electric wire 10 is coaxially sandwiched between the first annular member 35 and the outer peripheral surface (see FIGS. 4A and 5). The fixation of the first annular member 35 to the tubular member 31 is achieved by, for example, performing crimping (typically, processing of forming recesses in a direction of approaching a tubular axis at a plurality of positions).

The second annular member 36 is formed of metal, and is the same member as the first annular member 35 in this example. The second annular member 36 is fixed to an outer peripheral surface of the other side end portion of the tubular member 31 in a state in which the second braided conductor 23 of the second electric wire 20 is coaxially sandwiched between the second annular member 36 and the outer peripheral surface (see FIGS. 4A and 5). Similarly to the first annular member 35, the fixation of the second annular member 36 to the tubular member 31 is also achieved by, for example, performing crimping (typically, the processing of forming recesses in the direction of approaching the tubular axis at a plurality of positions).

As described above, the first and second annular members 35, 36 are fixed to the tubular member 31, so that the first and second annular members 35, 36 function to connect the first and second braided conductors 13, 23 to each other via the tubular member 31. The tubular member 31 functions to conduct the first and second braided conductors 13, 23 to each other via the tubular member 31. The configuration of each component of the electric wire connection structure 1 has been described above.

Next, a procedure for assembling the electric wire connection structure 1 shown in FIG. 5 will be described with reference to FIG. 5. As preparation for assembly, the water stop ring 32 is inserted into the center of the hollow part of the tubular member 31 in the tubular axial direction. The first electric wire holder 33 is inserted into the hollow part of the tubular member 31 from one side, and the lock protrusion 33*a* is engaged with the locking hole 31*a* on the one side of the tubular member 31. The second electric wire holder 34 is inserted into the hollow part of the tubular member 31 from the other side, and the lock protrusion 34*a* is engaged with the locking hole 31*a* on the other side of the tubular member 31. Accordingly, a subassembly of the tubular member 31 is produced in which the water stop ring 32 is sandwiched in the tubular axial direction by the first and second electric wire holders 33, 34 in the hollow part of the tubular member 31.

As preparation for assembly, the first annular member 35 and a tubular first water stop tube 50 are inserted through the first electric wire 10, and the second annular member 36 is inserted through the second electric wire 20. End processing is performed on the front end side end portions of the first and second electric wires 10, 20. The first water stop tube 50 is formed of a heat-shrinkable resin.

Specifically, as the end processing for the front end side end portion of the first electric wire 10, positions of front ends of the first conductive core wire 11, the inner sheath 12, the first braided conductor 13, and the outer sheath 14 are adjusted such that the front end of the first conductive core wire 11 is on the most front end side, the front end of the inner sheath 12 is closer to the base end side than the front end of the first conductive core wire 11, the front end of the first braided conductor 13 is closer to the base end side than the front end of the inner sheath 12, and the front end of the outer sheath 14 is closer to the base end side than the front end of the first braided conductor 13.

As the end processing for the front end side end portion of the second electric wire 20, positions of front ends of the second conductive core wire 21, the sheath 22, and the second braided conductor 23 are adjusted such that the front end of the second braided conductor 23 is on the most front end side, the front end of the second conductive core wire 21 is closer to the base end side than the front end of the second braided conductor 23, and the front end of the sheath 22 is closer to the base end side than the front end of the second conductive core wire 21.

In order to assemble the electric wire connection structure 1 shown in FIG. 5, first, the exposed inner sheath 12 (covering the first conductive core wire 11) of the first electric wire 10 is inserted through the hollow part of the subassembly of the tubular member 31 from one side, and the front end portion of the inner sheath 12 is protruded from the tubular member 31 to the other side. Accordingly, the water stop ring 32 and the first and second electric wire holders 33, 34 are provided between the inner peripheral surface of the tubular member 31 and the inner sheath 12 of the first electric wire 10.

Next, after a tubular second water stop tube 40 is inserted through the inner sheath 12 of the first electric wire 10 provided on the other side of the tubular member 31, the exposed first conductive core wire 11 of the first electric wire 10 and the exposed second conductive core wire 21 of the second electric wire 20 are conductively connected (see also 2). This conductive connection is typically achieved by performing welding using ultrasonic bonding or the like. The second water stop tube 40 is formed of a heat-shrinkable resin.

Next, the second water stop tube 40 inserted through the inner sheath 12 of the first electric wire 10 is moved to a position to cover a range from the front end portion of the inner sheath 12 to a front end portion of the sheath 22 of the second electric wire 20, and is heated and contracted. Accordingly, the second water stop tube 40 is brought into close contact with the range from the front end portion of the inner sheath 12 of the first electric wire 10 to the front end portion of the sheath 22 of the second electric wire 20 so as to cover the range. As a result, a connection part of the first conductive core wire 11 and the second conductive core wire 21 is isolated from the outside by the second water stop tube 40.

Next, in a state in which a front end portion of the first braided conductor 13 of the first electric wire 10 is placed on the outer peripheral surface of the one side end portion of the tubular member 31 and a front end portion of the second braided conductor 23 of the second electric wire 20 is placed on the outer peripheral surface of the other side end portion of the tubular member 31, the first annular member 35 inserted through the first electric wire 10 is moved to a position where a front end portion of the first braided conductor 13 is sandwiched between the first annular member 35 and the outer peripheral surface of the one side end portion of the tubular member 31, and the second annular member 36 inserted through the second electric wire 20 is moved to a position where a front end portion of the second braided conductor 23 is sandwiched between the second annular member 36 and the outer peripheral surface of the other side end portion of the tubular member 31. In this state, the first and second annular members 35, 36 are fixed to the tubular member 31 by performing crimping. Accordingly, the first and second braided conductors 13, 23 are connected to each other by the first and second annular members 35, 36 via the tubular member 31, and are conductive to each other via the tubular member 31.

Next, the first water stop tube 50 inserted into the first electric wire 10 is moved to a position to cover a range from a front end portion of the outer sheath 14 of the first electric wire 10 to a position (that is, in this example, a position near a center of the tubular member 31) closer to the other end side than the front end portion of the first braided conductor 13, and is heated and contracted. Accordingly, the first water stop tube 50 is brought into close contact with the range from the front end portion of the outer sheath 14 of the first electric wire 10 to the position near the center of the tubular member 31 so as to cover the range. As a result, the entire first braided conductor 13 exposed from the outer sheath 14 is isolated from the outside by the first water stop tube 50.

Accordingly, the assembly of the electric wire connection structure 1 shown in FIG. 5 is completed. In the electric wire connection structure 1 shown in FIG. 5, the first braided conductor 13 of the first electric wire 10 and the second braided conductor 23 of the second electric wire 20 are conductive to each other via the metal tubular member 31 of the connection device 30, and the first conductive core wire 11 of the first electric wire 10 and the second conductive core wire 21 of the second electric wire 20 are electrically connected to each other.

<Functions and Effects>

According to the connection device 30 in the present embodiment, the first and second braided conductors 13, 23 are conductively connected to each other via the tubular member 31 which is a conductor. Further, when the first annular member 35 is fixed to an opening end on one side of the tubular member 31, the first braided conductor 13 is sandwiched between the first annular member 35 and the tubular member 31, Similarly, when the second annular member 36 is fixed to an opening end on the other side of the tubular member 31, the second braided conductor 23 is sandwiched between the second annular member 36 and the tubular member 31. Therefore, it is possible to prevent, for example, the first and second braided conductors 13, 23 from being unintentionally separated from the tubular member 31. Therefore, the connection device 30 according to the present embodiment can appropriately electrically connect the pair of braided conductors 13, 23.

Further, according to the connection device 30 in the present embodiment, the connection tool 30 can be fixed to the first electric wire 10 inserted through the tubular member 31 using the first and second electric wire holders 33, 34. Therefore, it is possible to prevent unintended deformation of the first and second braided conductors 13, 23 such as expansion and contraction of the first and second braided conductors 13, 23 due to displacement of the connection device 30. Further, the water stop ring 32 is sandwiched between the first and second electric wire holders 33, 34, so that, for example in FIG. 5, it is possible to prevent water that has entered the inside of the tubular member 31 from the other side end of the tubular member 31 via the second braided conductor 23 of the second electric wire 20 from passing through the hollow part of the tubular member 31 and traveling toward the first electric wire 10.

Further, according to the connection device 30 in the present embodiment, the connection device 30 can be appropriately fixed to the first electric wire 10 by engaging the locking holes 31*a* of the tubular member 31 with the lock protrusions 33*a*, 34*a* of the first and second electric wire holders 33, 34. Since it is only necessary to engage the locking holes 31*a* of the tubular member 31 with the lock protrusions 33*a*, 34*a* of the first and second electric wire holders 33, 34, it is possible to improve workability of operation of connecting the pair of braided conductors 13, 23 using the connection device 30.

Further, according to the electric wire connection structure 1 in the present embodiment, it is possible to connect the first and second electric wires 10, 20 to each other while appropriately electrically connecting the pair of braided conductors 13, 23. In addition, by connecting the pair of braided conductors 13, 23 and connecting the first conductive core wire 11 and the second conductive core wire 21 independently of each other, a structure of the connection device 30 can be simplified and a size of the connection device 30 can be reduced.

Further, according to the electric wire connection structure 1 in the present embodiment, it is possible to connect the braided conductors 13, 23 belonging to both electric wires 10, 20 while connecting the first and second conductive core wires 11, 21 formed of different conductor materials.

Further, according to the electric wire connection structure 1 in the present embodiment, the exposed first braided conductor 13 is waterproofed by the first water stop tube 50, so that it is possible to prevent water from entering a part that is originally to be waterproofed via the first braided conductor 13.

Further, according to the electric wire connection structure 1 in the present embodiment, the connection part of the first conductive core wire 11 and the second conductive core wire 21 is waterproofed. Accordingly, even when the first conductive core wire 11 and the second conductive core wire 21 are formed of different materials as in this example, it is possible to prevent corrosion of the first and second conductive core wires 11, 21 at the connection part.

Other Embodiments

The present disclosure is not limited to the above-described embodiment and various modifications can be used within the scope of the present disclosure. For example, the present disclosure is not limited to the above-described embodiment, and may be appropriately modified, improved, or the like. Additionally, materials, shapes, sizes, numbers, arrangement positions, or the like of constituent elements in the above-described embodiment are optional and are not limited as long as the present disclosure can be achieved.

For example, in the above-described embodiment, the first and second wire holders 33, 34 are fixed to the tubular member 31 by engaging the locking holes 31*a* of the tubular member 31 with the lock protrusions 33*a*, 34*a* of the first and second electric wire holders 33, 34. On the other hand, when the first and second annular members 35, 36 are fixed to the tubular member 31 by performing crimping, the first and second electric wire holders 33, 34 may be fixed to the tubular member 31 by deformation of the tubular member 31 accompanying the crimping. Accordingly, it is possible to omit forming the locking holes 31*a* in the tubular member 31 and providing the lock protrusions 33*a*, 34*a* at the first and second electric wire holders 33, 34, respectively.

Further, in the above-described embodiment, the tubular member 31 is a metal cylindrical member. On the other hand, the tubular member 31 may be a resin tubular member provided with a metal film.

Further, as an example of the electric wire connection structure 1 in the above-described embodiment, the first electric wire 10 including the round rod-shaped first conductive core wire 11 and the second electric wire 20 including the flat plate-shaped second conductive core wire 21 are connected to each other. The first braided conductor 13 of the first electric wire 10 is covered with the outer sheath 14 and is built in the first electric wire 10 itself, and the second braided conductor 23 of the second electric wire 20 covers the sheath 22 and is exposed to the outside. On the other hand, the structure of each electric wire used in the electric wire connection structure 1 is not limited to this example. For example, the connection structure 1 may connect the first electric wires 10 to each other, may connect the second electric wires 20 to each other, may connect the first electric wire 10 or the second electric wire 20 to another type of electric wire (for example, a twisted electric wire), or may connect other types of electric wires to each other.

Here, characteristics of the connection device 30 and the electric wire connection structure 1 according to the present disclosure will be briefly summarized and listed in the following [1] to [8].

[1] A connection device (30) including:

a first braided conductor (13) having a tubular shape;

a second braided conductor (23) having a tubular shape;

a tubular member (31) having a first opening end and a second opening end, the tubular member having conductivity;

a first annular member (35) configured to be fixed to the first opening end in a state that the first braided conductor (13) is sandwiched coaxially between the first annular member (35) and an outer peripheral surface of the first opening end; and a second annular member (36) configured to be fixed to the second opening end in a state that the second braided conductor (23) is sandwiched coaxially between the second annular member (36) and an outer peripheral surface of the second opening end, in which the first braided conductor (13) and the second braided conductor (23) are conductively connected to each other through the tubular member (31).

[2] The connection device (30) according to [1], further including:

a first annular electric wire holder (33) provided between a first inner peripheral surface of the tubular member (31) and a first electric wire (10) which is covered with the first braided conductor (13) to hold the first electric wire when the first electric wire (10) is inserted through the tubular member (31);

a second annular electric wire holder (34) provided between a second inner peripheral surface of the tubular member (31) and a second electric wire (20) which is covered with the second braided conductor (23) to hold the second electric wire when the second electric wire (20) is inserted through the tubular member (31); and an annular water stop ring (32) sandwiched between the first electric wire holder (33) and the second electric wire holder (34) in a tubular axial direction of the tubular member (31).

[3] The connection device (30) according to [2], in which each of the first and second electric wire holders (33, 34) has a locked portion (33*a*, 34*a*) configured to be engaged with corresponding one of locking portions (31*a*) of the tubular member (31) so as to be fixed to the tubular member (31).

[4] The connection device (30) according to [2], in which the first annular member (35) and the second annular member (36) are fixed to the tubular member (31) by crimping the tubular member (31), and in which the first and second electric wire holders (33, 34) are fixed to the tubular member (31) by deformation of the tubular member (31) due to the crimping.

[5] An electric wire connection structure (1) including:

the connection device (30) according to any one of to [4], the first electric wire (10) having a first conductive core wire (1) and being surrounded by the first braided conductor (13); and the second electric wire (20) having a second conductive core wire (21) and being surrounded by the second braided conductor (23), in which the first conductive core wire (11) is inserted through the tubular member (31) of the connection device (30), and the first braided conductor (13) is fixed to the first opening end of the tubular member (31) in a state of being coaxially sandwiched between an outer peripheral surface of the first opening end and the first annular member (35), and in which the second conductive core wire (21) is inserted through the tubular member (31) of the connection device (30), and the second braided conductor (23) is fixed to the second opening end of the tubular member (31) in a state of being coaxially sandwiched between an outer peripheral surface of the second opening end and the second annular member (35),

[6] The electric wire connection structure (1) according to [5], in which the first conductive core wire (11) and the second conductive core wire (21) are comprised of different conductor materials from one another.

[7] The electric wire connection structure (1) according to [5] or [6], further including:

a first water stop tube (50) having a tubular shape and configured to cover at least one of the first braided conductor (13) and the second braided conductor (23) so as to isolate the at least one of the first braided conductor (13) and the second braided conductor (23) from an outside.

[8] The electric wire connection structure (1) according to any one of [5] to [7], further including:

a second water stop tube (40) having a tubular shape and configured to cover a connection part of the first conductive core wire (11) and the second conductive core wire (21) so as to isolate the connection part from an outside.

According to the connection device having the configuration in [1], the first and second braided conductors are conductively connected to each other via the tubular body. Further, when the first annular member is fixed to the first opening end of the tubular member, the first braided conductor is sandwiched between the first annular member and the tubular member. Similarly, when the second annular member is fixed to the second opening end of the tubular member, the second braided conductor is sandwiched between the second annular member and the tubular member. Accordingly, the first and second braided conductors can be electrically connected to each other by simple operation as compared to a case in which the braided conductors are directly joined to each other. The first annular member and the second annular member can prevent the braided conductors from being unintentionally separated from the tubular member. Therefore, the connection device of this configuration can appropriately electrically connect the first and second braided conductors to each other.

According to the connection device having the configuration in [2], the connection device can be fixed to the first and second electric wires inserted through the tubular member using the first and second electric wire holders. Therefore, it is possible to prevent unintended deformation of the braided conductors such as expansion and contraction of the braided conductors due to displacement of the connection device relative to the electric wires. Further, the water stop ring is sandwiched between the first and second electric wire holders, so that it is possible to prevent water from passing through an inside of the tubular member. Accordingly, for example, when protective sheaths of the first and second electric wires are peeled off and the braided conductors are pulled out, it is possible to prevent water from entering the electric wires.

According to the connection device having the configuration in [3], the connection device can be appropriately fixed to the first and second electric wires by engaging the tubular member with the first and second electric wire holders. Accordingly, since the first and second braided conductors can be fixed only by engaging the locking portions of the tubular member with the locked portions of the first and second electric wire holders, it is possible to improve workability of operation of connecting the first and second braided conductors using the connection device.

According to the connection device having the configuration in [4], when the first annular member and the second annular member is crimped to the tubular member, the tubular member can be fixed to the first and second electric wire holders by deformation (for example, generation of a recess in a direction of approaching a tubular axis) of the tubular member. Accordingly, since the first and second annular members, the first and second braided conductors, the tubular member, and the first and second electric wire holders can be collectively fixed by performing the above-described crimping, it is possible to improve the workability of the operation of connecting the first and second braided conductors using the connection device.

According to the electric wire connection structure having the configuration in [5], the first and second braided conductors are conductively connected to each other via the tubular member. Further, when the first annular member is fixed to the first opening end of the tubular member, the first braided conductor is sandwiched between the first annular member and the tubular member. Similarly, when the second annular member is fixed to the second opening end of the tubular member, the second braided conductor is sandwiched between the second annular member and the tubular member. Accordingly, the first and second braided conductors can be electrically connected to each other by simple operation as compared to a case in which the braided conductors are directly joined to each other. The first annular member and the second annular member can prevent the braided conductors from being unintentionally separated from the tubular member. Further, the first conductive core wire and the second conductive core wire are electrically connected to each other. Therefore, the connection structure having this configuration can connect the electric wires to each other while appropriately electrically connecting the pair of braided conductors.

According to the electric wire connection structure having the configuration in [6], it is possible to appropriately connect the first and second braided conductors to each other while connecting electric wires including conductive core wires (for example, a copper conductive core wire and an aluminum conductive core wire) made of different conductor materials.

According to the electric wire connection structure having the configuration in [7], at least one of the first and second braided conductors is covered with the water stop tube to be isolated from the outside, so that in addition to preventing the braided conductors from being exposed to water, it is possible to prevent the conductive core wire of the electric wire in at least one of the first and second braided conductor from being exposed to water.

According to the electric wire connection structure having the configuration in [8], the connection part of the first conductive core wire and the second conductive core wire is covered with the water stop tube, so that, for example, it is possible to prevent corrosion so-called galvanic corrosion) that may occur at the connection part when the first conductive core wire and the second conductive core wire are formed of different materials.

What is claimed is:

1. A connection device comprising:

a first braided conductor having a tubular shape;

a second braided conductor having a tubular shape;

a tubular member having a first opening end and a second opening end, the tubular member having conductivity;

a first annular member configured to be fixed to the first opening end in a state that the first braided conductor is sandwiched coaxially between the first annular member and an outer peripheral surface of the first opening end;

a second annular member configured to be fixed to the second opening end in a state that the second braided conductor is sandwiched coaxially between the second annular member and an outer peripheral surface of the second opening end: and a first annular electric wire holder provided between a first inner peripheral surface of the tubular member and a first electric wire which is covered with the first braided conductor to hold the first electric wire when the first electric wire is inserted through the tubular member, wherein the first braided conductor and the second braided conductor are conductively connected to each other through the tubular member; and wherein the tubular member has a locking hole and the first annular electric wire holder has a lock protrusion that engages with the locking hole.

2. The connection device according to claim 1, further comprising:

a second annular electric wire holder provided between a second inner peripheral surface of the tubular member and a second electric wire which is covered with the second braided conductor to hold the second electric wire when the second electric wire is inserted through the tubular member; and an annular water stop ring sandwiched between the first electric wire holder and the second electric wire holder in a tubular axial direction of the tubular member.

3. The connection device according to claim 2, wherein each of the first electric wire holder and the second electric wire holder has a locked portion configured to be engaged with corresponding one of locking holes of the tubular member so as to be fixed to the tubular member.

4. The connection device according to claim 2, wherein the first annular member and the second annular member are fixed to the tubular member by crimping the tubular member; and wherein the first electric wire holder and the second electric wire holder are fixed to the tubular member by deformation of the tubular member due to the crimping.

5. An electric wire connection structure comprising:

the connection device according to claim 1;

the first electric wire having a first conductive core wire and being surrounded by the first braided conductor; and the second electric wire having a second conductive core wire and being surrounded by the second braided conductor, wherein the first conductive core wire is inserted through the tubular member, and the first braided conductor is fixed to the first opening end of the tubular member in a state of being coaxially sandwiched between an outer peripheral surface of the first opening end and the first annular member; and wherein the second conductive core wire is inserted through the tubular member, and the second braided conductor is fixed to the second opening end of the tubular member in a state of being coaxially sandwiched between an outer peripheral surface of the second opening end and the second annular member.

6. The electric wire connection structure according to claim 5, wherein the first conductive core wire and the second conductive core wire are comprised of different conductor materials from one another.

7. The electric wire connection structure according to claim 5, further comprising:

a first water stop tube having a tubular shape and covering at least one of the first braided conductor and the second braided conductor so as to isolate the at least one of the first braided conductor and the second braided conductor from an outside.

8. The electric wire connection structure according to claim 5, further comprising:

a second water stop tube having a tubular shape and configured to cover a connection part of the first conductive core wire and the second conductive core wire so as to isolate the connection part from an outside.

9. The electric wire connection structure according to claim 8, wherein the second water stop tube is covered by the second braided conductor.

10. The electric wire connection structure according to claim 1, wherein the lock protrusion engages and extends through the locking hole, such that the lock protrusion abuts the first braided conductor.

11. The electric wire connection structure according to claim 1, wherein the annular water stop ring is formed of rubber;

wherein an inner peripheral lip portion is formed on an outer peripheral surface of the water stop ring and an outer peripheral lip portion is formed on an inner peripheral surface of the water stop ring; and wherein the outer peripheral lip portion is in close contact with an inner peripheral surface of the tubular member, and the inner peripheral lip portion is in close contact with an outer peripheral surface of the first electric wire inserted into the tubular member.

* * * * *